United States Patent [19]

Richardt

[11] Patent Number: 4,854,290

[45] Date of Patent: Aug. 8, 1989

[54] AIR PREHEATING DEVICE FOR AN INTERNAL COMBUSTION ENGINE

[75] Inventor: Karl-Heinz Richardt, Lohmar, Fed. Rep. of Germany

[73] Assignee: Kloeckner-Humboldt-Deutz AG, Fed. Rep. of Germany

[21] Appl. No.: 100,924

[22] Filed: Sep. 25, 1987

[30] Foreign Application Priority Data

Oct. 2, 1986 [DE] Fed. Rep. of Germany ..... 3633512

[51] Int. Cl.[4] ..... F02M 27/08; F02M 31/04

[52] U.S. Cl. ..... 123/556; 123/179 H

[58] Field of Search ..... 123/556, 179 G, 179 H, 123/179 L

[56] References Cited

U.S. PATENT DOCUMENTS

| | | | |
|---|---|---|---|
| 3,335,710 | 8/1967 | Reddy | 123/556 |
| 3,949,723 | 4/1976 | Beesch | 123/556 |
| 3,961,611 | 6/1976 | Fränkle et al. | 123/556 |
| 4,627,405 | 12/1986 | Imhof et al. | 123/556 |
| 4,768,481 | 9/1988 | Wood | 123/556 |

FOREIGN PATENT DOCUMENTS 2029271 6/1970 Fed. Rep. of Germany .

*Primary Examiner*—Willis R. Wolfe
*Assistant Examiner*—M. Macy
*Attorney, Agent, or Firm*—Charles L. Schwab

[57] ABSTRACT

An air preheating device for diesel internal combustion engines, includes a fuel atomizer (2) and an ignition device arranged in the air intake pipe (1). In order to achieve reliable ignition and sufficient preheating of induction air having pulsating currents, an ultrasonic atomizer is used and its atomized stream (3) is located in a zone (5) of stabilized air flow in the intake pipe. The ignition device (4) is also positioned in the zone (5) of stabilized flow and ignites the atomized stream (3). The ultrasonic element (13) is cooled by being positioned in a cool partial current of the intake air.

13 Claims, 1 Drawing Sheet

AIR PREHEATING DEVICE FOR AN INTERNAL COMBUSTION ENGINE

TECHNICAL FIELD

This invention relates to an air preheating device for a diesel engine.

PRIOR ART STATEMENT

West German patent DE-PS No. 907 003 shows an air preheating device which is arranged within the intake pipe of the internal combustion engine. Fuel delivered to a fuel atomizer under pressure atomizes when it escapes through a mechanically adjustable atomizing nozzle, and is then ignited by a downstream positioned ignition device. The fuel is delivered to the fuel atomizer by a supply pump which in one embodiment is driven by a motor.

A disadvantage of this arrangement is that a correspondingly high pressure level must be built up for a sufficient degree of atomization, to which end the pump must be designed accordingly. In the motor driven pump embodiment the pump is driven continuously by the motor. Since the air preheating device is only occasionally needed, the pump is not required during the greater part of the operating period of the internal combustion engine and consumes energy unnecessarily.

West German patent DE-OS No. 20 29 271 shows a fuel injection system for mixture-intaking internal combustion engines, whereby an ultrasonic atomizer is used in order to atomize the fuel in the air intake pipe. The ultrasonic atomizer is installed in a fuel circulation system in order to produce a fuel vapor and achieves a free flowing stream of an air/fuel mixture in the air intake pipe.

OBJECTS AND SUMMARY OF THE INVENTION

It is an object of this invention to provide an air preheating device for use with continuous or pulsating flows, which guarantees reliable ignition and combustion of the atomized fuel.

In the present invention both the fuel atomizer and the ignition device are located in the air intake pipe. The fuel atomizer is an ultrasonic atomizer positioned in the intake pipe in a zone of stabilized flow, and the ignition also takes place within this zone. This provides fine distribution, trouble-free ignition and complete combustion of the fuel vapor whereby the heated intake air is substantially free of ignitable mixtures (which are particularly undesirable in intake air for diesel internal combustion engines).

Adequate cooling of the ultrasonic atomizer is provided by positioning the ultrasonic element in an air channel through which a part of the intake air flows. This cooling permits the atomizer to be operated for longer periods of time.

In one embodiment of the invention, the ultrasonic atomizer is positioned coaxially in the center of the air intake pipe and a casing sheath is arranged around the ultrasonic atomizer. The casing sheath encompasses the ultrasonic atomizer and the atomized fuel stream to form a current-stabilized zone. In order to avoid stimulating the casing sheath, provisions are made for keeping the ultrasonic atomizer and the casing sheath separate from each other in the air intake pipe.

BRIEF DESCRIPTION OF THE DRAWINGS

Two embodiments of the invention are shown in the drawings, in which.

DETAILED DESCRIPTION OF THE DRAWINGS

Figure 1:
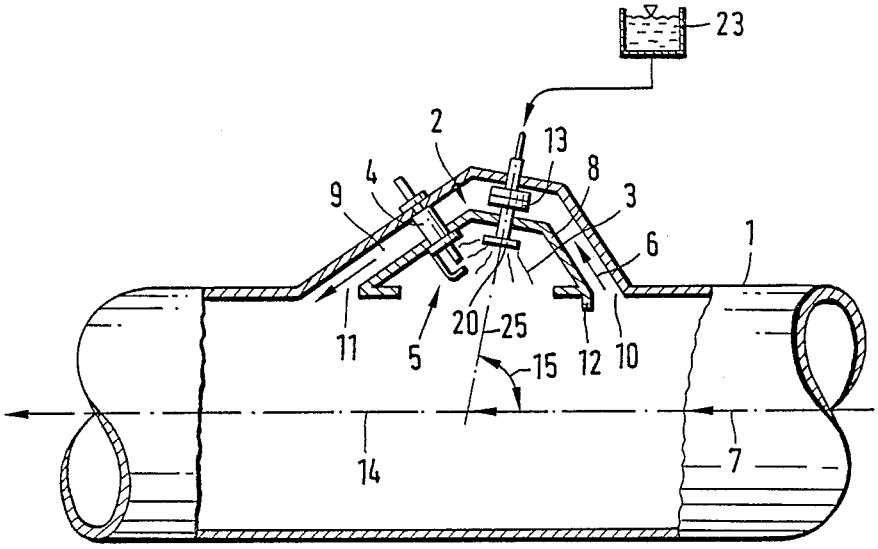
FIG. 1 is a longitudinal section of an intake pipe with the air preheating device at one side of the pipe.

As shown in FIG. 1, the air preheating device is installed as an insert in the outer circumference of the air intake pipe 1. This insert includes inner and outer walls forming an integral unit with the air intake pipe 1 and with the outer walls forming a bulge in the intake pipe in which the curved casing 8 is disposed. The inner walls form a trapezoid-shaped part or casing 8, as viewed in section in FIG. 1, and together with the outer wall forms a partial flow channel 9. The curved casing 8 formed by the inner walls defines a burning cavity which is open to the interior of the air intake pipe along the entire axial length of the base-side of the trapezoid and "communicates" with the air flowing in the intake pipe 1. The interior of the casing 8 forms a zone 5 of stabilized flow, which is predominantly influenced by the flow of the intake air 7 in the intake pipe 1. As shown in FIG. 1, the casing 8 lies radially outward of the cross-sectional flow stream of intake air in the air intake pipe 1.

Relative to the direction of air flow, the channel 9 has an air inlet opening 10 upstream of zone 5 and an air outlet opening 11 downstream of the zone 5. The downstream edge of the air inlet opening 10 is provided with a deflector or air-conducting plate 12 for deflecting a partial air current 6, which is bifurcated or split from the intake air flow 7.

An ultrasonic atomizer 2 is secured to the intake pipe 1 and casing 8 in such a way that the ultasonic element 13 is located in the channel 9 and the nozzle element 20 is located in the zone 5 of stabilized flow. As illustrated, the nozzle element 20 extends through an opening in the casing 8 so that its discharge end is located just beneath the small base side of the trapezoid-shaped casing 8. The axis 25 of the ultrasonic atomizer 2 forms acute angle 15 with respect to the in-flowing intake air 7 which flows in the direction of the axis 14.

Relative to the direction of air flow, an ignition device 4 is positioned in the casing 8 downstream of the ultrasonic atomizer 2 which, as illustrated, is a high-voltage spark plug. It can be expidient to provide an incandescent rod as the ignition device. The ignition device 4 is mounted on the intake pipe 1 and casing 8 with an inner igniting end extending through an opening in the casing so that it is located in the zone 5 of stabilized flow and in the atomized stream 3 which escapes from the nozzle element 20. The ultrasonic atomizer 2 is connected directly to a fuel tank 23.

The atomized stream 3 which flows almost pressure-free from the piezo-ceramic ultrasonic atomizer 2 enters the zone 5 of stabilized air flow and there is ignited by the electrical ignition device 4. The fuel which is continually vaporized by the ultrasonic atomizer 2 in the zone 5 is burned continuously in zone 5, which functions as a combustion chamber, and heats the cold induction air 7. The atomized stream 3 which flows almost pressure-free from the piezo-ceramic ultrasonic atomizer is, because of the arrangement in this invention, not disturbed or diverted by the pulsating flow of the induction air 7. Thus, a precise ignition and combustion of the fuel which is injected for heating the inducting air 7 is guaranteed at every performance level of the internal combustion engine.

By locating the piezo-ceramic ultrasonic element 13 of the ultrasonic atomizer 2 in the channel 9, it is cooled by the partial current 6 of the cold induction air 7. The partial current 6 which serves to provide the cooling effect is discharged to the induction air 7 via the air outlet opening 11 downstream of the preheating zone 5.

Figure 2:
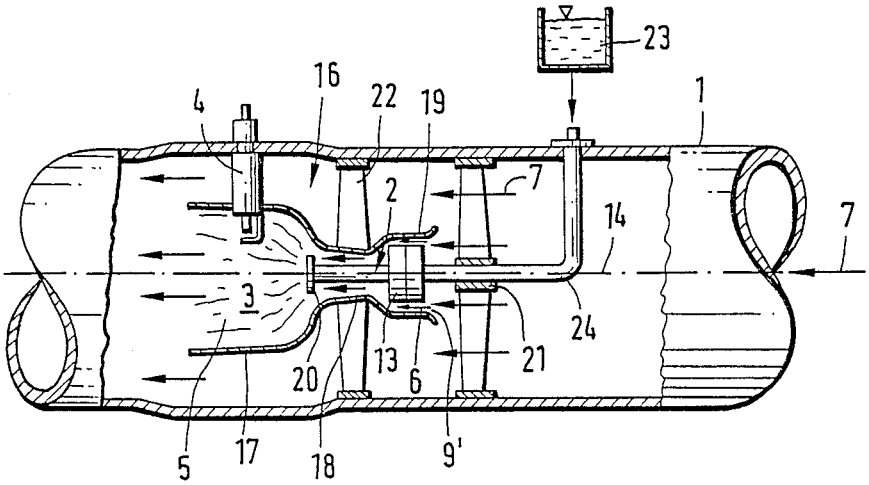
FIG. 2 is a longitudinal section of an air intake pipe with the air preheating device positioned in the center thereof.

In the embodiment of FIG. 2, the air preheating device is arranged in the center of the intake pipe 1 whereby the axis of the ultrasonic atomizer 2 is located on the axis 14 of the air intake pipe 1. The fuel line 24 which is located inside the intake pipe 1 is designed to be rigid and has a first part which is coaxial with the axis 14 of intake pipe 1, and a second part—perpendicular to the first partial section—extending from the center of the air intake pipe 1 through its outer casing and connected to a fuel tank 23.

The first part of the fuel line 24 is supported by a support 21 which consists primarily of an inner ring and an outer ring interconnected by braces which are radially disposed to act as air-conducting plates. The first part of the fuel line 24 is rigidly supported in the inner ring and the outer ring is secured to the inner circumference of the intake pipe 1. The ultrasonic element 13 is supported centrally on the axis 14 of the air intake pipe 1 by the support 21 and the rigid fuel line 14.

The ultrasonic atomizer 2 is surrounded without contact by annular walls forming a casing sheath 16, the axis of which also lies on the axis 14 of the intake pipe 1. The casing sheath 16 consists of three sections which are designed so they have differing diameters, wherein, the middle section 18, with the smallest diameter, is rigidly engaged by a support 22 which keeps the casing sheath 16 in its coaxial position in the intake line 1. The support 22 is designed similarly to support 21 and is fastened to the intake pipe 1.

The section 19 of th casing sheath 16 is connected to the upstream end of the section 18 and has a larger diameter than that of section 18. The section 19 circumferentially surrounds the ultrasonic element 13 and, with it, forms the boundaries of a ring channel 9'. The edge of section 19 which faces the in-flowing induction air 7 is flared radially outward to form an air deflector.

A section 17 of the sheath 16 has the greatest diameter of any of the sheath sections and is connected to the downstream end of the middle section 18. The interior of the section 17 forms the zone 5 of stabilized flow. The outlet nozzle 20 of the ultrasonic atomizer 2 is located in the transitional area between sections 18 and 17.

In order to be sure that the narrowing of the average cross-section in the remaining air intake pipe 1 does not become too great in the area of the greatest diameter (section 17) of the casing sheath 16, the air intake pipe is designed to have an increased diameter in the area radially outward of section 17.

The ignition device 4 is rigidly fastened in the outer casing of the air intake pipe 1 and extends through a radial opening into the casing sheath 16 and into the zone 5 of stabilized flow.

The in-flowing induction air 7 is divided at the flared inlet of casing sheath 16 into a primary current and a partial current 6. The partial current 6 enters the ring channel 9', cools the ultrasonic element 13 and proceeds through the intermediate section 18 with the smallest diameter into the zone 5 of stabilized flow. Since the increase in diameter from the middle section 18 to section 17 with the greatest diameter is very great, the axial flow velocity in the area of zone 5 is very small, and thus the atomized stream 3 which flows from the nozzle 20 can be reliably ignited by the ignition device 4 and effectively heats the induction air 7. At the outlet of zone 5 the heated partial current is mixed with the primary current which flows between the casing sheath 16 and the cylindrical wall of the intake pipe 1 and is delivered to the internal combustion engine, not shown.

The air preheating device of this invention is suitable for use in continuous and pulsating currents, especially as they are used in internal combustion engines, and especially diesel engines.

The embodiments of the invention in which an exclusive property or privilege is claimed are defined as follows:

1. An air preheating device for an internal combustion engine having an air intake pipe comprising: a casing (8, 16) in said intake pipe bifurcating intake air flowing in said intake pipe into a main air current and a partial air current (6), said casing and intake pipe defining an air channel therebetween and said casing being curved to form a burning cavity open to the interior of said intake pipe and forming a zone (5) of stabilized intake air flow, an ultrasonic atomizer (2) mounted on said intake pipe and extending through an opening in said casing and into said cavity, said atomizer including an atomizer element operable to produce an atomized stream (3) in said zone (5) of stabilized flow and an ignition device (4) mounted on said intake pipe with an ignitor end extending through an opening in said casing and into said cavity, said ignition device being operable to ignite said atomized stream (3) in the zone (5) of the stabilized flow, said ultrasonic atomizer (2) being so positioned that said intake air (7) circulates around said atomizer element and cools it.

2. The air preheating device of claim 1, wherein said casing is disposed radially outward of the cross-sectional air flow in said intake pipe (1) and wherein said ultrasonic atomizer (2) and ignition device (4) are mounted on said casing, said cavity being open to the interior of said air intake pipe (1) along the greater part of the axial length of said casing (8) to permit free flow communication of said cavity with the intake air in said intake pipe (1).

3. The air preheating device of claim 2, wherein said casing (1) and intake pipe (1) define a channel (9) which guides said partial air current (6), including an air inlet opening (10) in upstream relation to said zone (5) of stabilized flow and an air outlet opening (11) downstream of said zone (5) in communication with said intake pipe and wherein said ultrasonic atomizer (2) includes an ultrasonic element (13) disposed in said channel (9).

4. The air preheating device of claim 3 and further comprising an air-conducting plate (12) at the downstream edge of said air inlet opening (10) extending radially inward relative to said intake pipe (1).

5. The air preheating device of claim 1 wherein said ultrasonic atomizer (2) is disposed at an open, acute angle (15) relative to the axial direction of intake air flow in said intake pipe (1).

6. The air preheating device of claim 1 wherein said casing as a casing sheath (16) mounted within said air intake pipe and circumferentially surrounding said ultrasonic atomizer (2) and its atomized stream (3).

7. The air preheating device of claim 6 wherein said casing sheath (16) is coaxial to the axis (14) of said air inlet pipe (1) and includes a section (17) with an enlarged inner diameter in the area of the atomized stream (3).

8. The air preheating device of claim 7 wherein said casing sheath (16) includes a section (19) forming a ring channel (9') which conducts said partial air current (6) around said ultrasonic element (13), thereby cooling the latter.

9. The air preheating device of claim 8, wherein said casing sheath (16) includes a section (18) with the least diameter between said ring channel (9') and said enlarged diameter section (17).

10. The air preheating device of claim 6 wherein said casing sheath (16) and said ultrasonic atomizer (2) are kept separate from each other in said air intake pipe (1).

11. The air preheating device of claim 6 wherein said ignition device (4) is secured in the air inlet pipe (1) and extends into said enlarged diameter section (17) of said casing sheath (16).

12. The air preheating device of claim 6 wherein said air intake pipe (1) is increased in diameter in the area radially outward of said section (17) of said casing sheath (16).

13. An air preheating device for an internal combustion engine having an air intake pipe comprising:

wall means defining a bulge in said intake pipe, a casing (8) in said intake pipe disposed within said bulge and radially outward of the cross-sectional flow stream of intake air in said air intake pipe including an arched wall spaced radially inward of said bulge to form a secondary flow channel (9) in said intake pipe bifurcating intake air flow in said intake pipe into a main air current and a partial air current (6), the radially inner side of said casing forming a cavity open in a radially inward direction to provide unobstructed communication with the interior of said intake pipe and forming a zone (5) of stabilized intake air flow, an ultrasonic atomizer (2) mounted on said casing and producing an atomized stream (3) in said zone (5) of stabilized flow and an ignition device (4) mounted on said casing pperable to ignite said atomized stream (3) in the zone (5) of the stabilized flow, said ultrasonic atomizer (2) being so positioned that said partial current (6) of intake air (7) circulates around the ultrasonic atomizer (2) and cools it.

* * * * *

UNITED STATES PATENT AND TRADEMARK OFFICE

CERTIFICATE OF CORRECTION

PATENT NO. : 4,854,290

DATED : August 8, 1989

INVENTOR(S) : Richardt, Karl-Heinz

It is certified that error appears in the above-identified patent and that said Letters Patent is hereby corrected as shown below:

Column 2, Line 45, cancel "small" and substitute "smaller"

Column 4, Line 68, cancel "as" and substitute "is"

Column 6, Line 21, cancel "pperable" and substitute "operable"

Signed and Sealed this

Twelfth Day of June, 1990

*Attest:*

HARRY F. MANBECK, JR.

*Attesting Officer*

*Commissioner of Patents and Trademarks*